United States Patent [19]

Finn

[11] Patent Number: 4,984,412

[45] Date of Patent: Jan. 15, 1991

[54] HOPPER APPARATUS

[75] Inventor: Everett N. Finn, Macon, Ga.

[73] Assignee: Brown & Williamson Tobacco Corporation, Louisville, Ky.

[21] Appl. No.: 485,023

[22] Filed: Feb. 26, 1990

[51] Int. Cl.[5] ..... B65B 11/06; B65B 49/00; B65B 51/00

[52] U.S. Cl. ..... 53/387; 53/230; 53/39 B

[58] Field of Search ..... 53/53, 54, 230, 231, 53/373, 375, 379, 387, 388, 393, 541; 414/795.3; 221/281

[56] References Cited

U.S. PATENT DOCUMENTS

| | | | |
|---|---|---|---|
| 2,118,994 | 5/1938 | Wade | 221/281 X |
| 2,216,064 | 9/1940 | Becker | 221/281 X |
| 2,915,867 | 12/1959 | Frank et al. | 53/230 |
| 2,947,125 | 8/1960 | Wilson et al. | 53/541 X |
| 3,145,518 | 8/1964 | Ricca | 53/387 |
| 3,200,555 | 8/1965 | Liedtke | 53/388 X |
| 3,402,528 | 9/1968 | Schmermund | 53/230 |
| 3,517,482 | 6/1970 | Beninger | 53/387 |

*Primary Examiner*—Robert L. Spruill
*Assistant Examiner*—Daniel Moon
*Attorney, Agent, or Firm*—Charles G. Lamb

[57] ABSTRACT

A hopper apparatus for folding the end flaps of a film overwrapper across the ends of a carton enclosed in the overwrapper includes a back wall, two parallel side walls, and an access door closing the front side of the hopper. The top horizontal edges of the side walls, back wall, and closed access door define the open top end of the hopper, and the horizontal bottom edges of the back wall, side walls and closed access door define the open bottom end of the hopper. Carton engaging fingers are attached to the back wall for movement into and out of the hopper, and carton engaging fingers are also attached to the access door at the same elevation in the hopper as the engagement fingers on the back wall for movement into and out of the hopper.

9 Claims, 2 Drawing Sheets

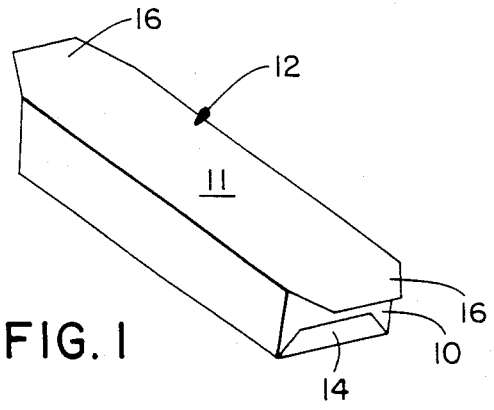
FIG. 1
FIG. 2
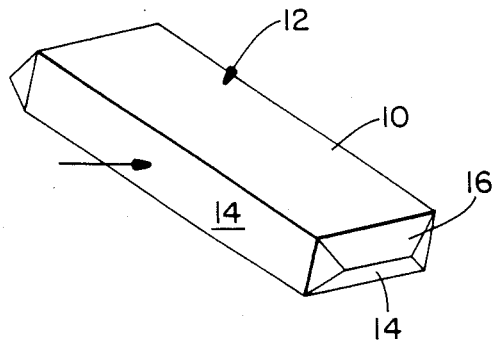
FIG. 3
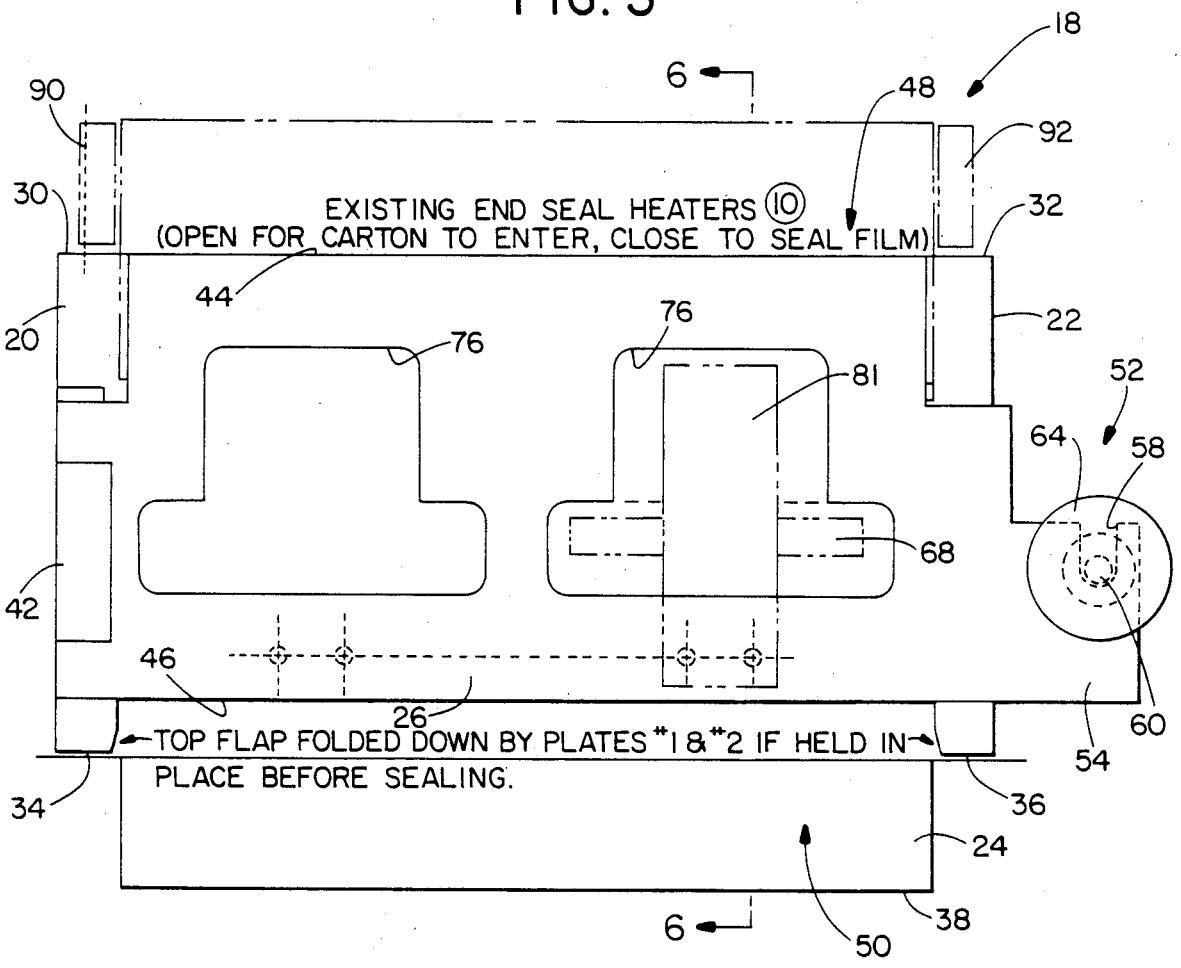

HOPPER APPARATUS

BACKGROUND OF THE INVENTION

1. Field of the Invention

The present invention relates to hoppers, and more particularly to hoppers for folding the end flaps of a film overwrapper across the ends of a carton enclosed in the overwrapper for completing the packaging of the carton in the overwrapper.

2. Discussion of the Prior Art

Hoppers for folding the end flaps of a film overwrapper across the ends of a carton enclosed in the overwrapper for completing the packaging of the carton in the overwrapper film are known.

Such hoppers are conventionally used in the tobacco industry to apply a film overwrapper to a carton of cigarette packages.

The conventional hopper of this type includes a back wall, spaced apart side walls, and a front wall. Carton engagement fingers are mounted to the back wall and to the front wall for movement into and out of the hopper.

In use, cartons circumscribed by and, therefore, enclosed in the film wrapper are forced upwardly through the open bottom end of the hopper to the open top end of the hopper wherein the side walls of the hopper function to fold the end flaps of the overwrapper over the ends of the carton to complete the packaging of the carton in the overwrapper.

A problem occurs in these heretofore known hoppers when cartons become jammed in the hopper, or when it is otherwise necessary to clear the hopper of cartons as may occur when it is necessary to change over from packaging one brand of cigarettes to another brand of cigarettes.

SUMMARY OF THE INVENTION

The present invention recognizes the drawbacks of the heretofore known hopper discussed above, and provides a straightforward solution which makes it very easy to clear the hopper of jammed cartons, or remove cartons from the hopper for other reasons.

More particularly, the present invention provides 8 hopper apparatus for folding the end flaps of a film overwrapper across the ends of a carton enclosed in the overwrapper for completing the packaging of the carton in the overwrapper comprising: first and second spaced apart, parallel side walls; a back wall perpendicular to and spanning the space between the side walls, said side walls having back vertical edges and said back wall being affixed to the back vertical edges of the side walls; an access door pivotably attached to the vertical front edge of the first side wall for movement between a closed position spanning the space between the side walls and parallel to the back wall closing the entire front side of the hopper and an open position away from the space between the first and second side walls completely opening the front side of the hopper; said first and second side walls, said top back wall, and said across door having top edges, said top edges in the closed position cooperating to define a top open end of the hopper; said first and second side walls, said back wall, and said access door having bottom edges, said bottom edges in the closed position cooperating to define a bottom open end of the hopper; and, latch means interconnecting the access door and the second side wall to latch the access door in the closed position.

BRIEF DESCRIPTION OF THE DRAWINGS

A better understanding of the present invention will be had upon reference to the following discussion in conjunction with the accompanying drawings wherein like numerals refer to like parts throughout the several views and in which:

FIG. 1 is a perspective view of a carton circumscribed by a film overwrapper with an end flap yet to be folded over the end of the carton to complete the packaging of the carton;

FIG. 2 is a perspective view of the carton of FIG. 1 with the end flap folded over the end of the carton completing the packaging of the carton;

FIG. 3 is a front view of a hopper of the present invention for folding the end flap of the overwrapper over the end of the carton to complete the packaging of the carton;

DETAILED DESCRIPTION OF THE PREFERRED EMBODIMENT

Figure 4:
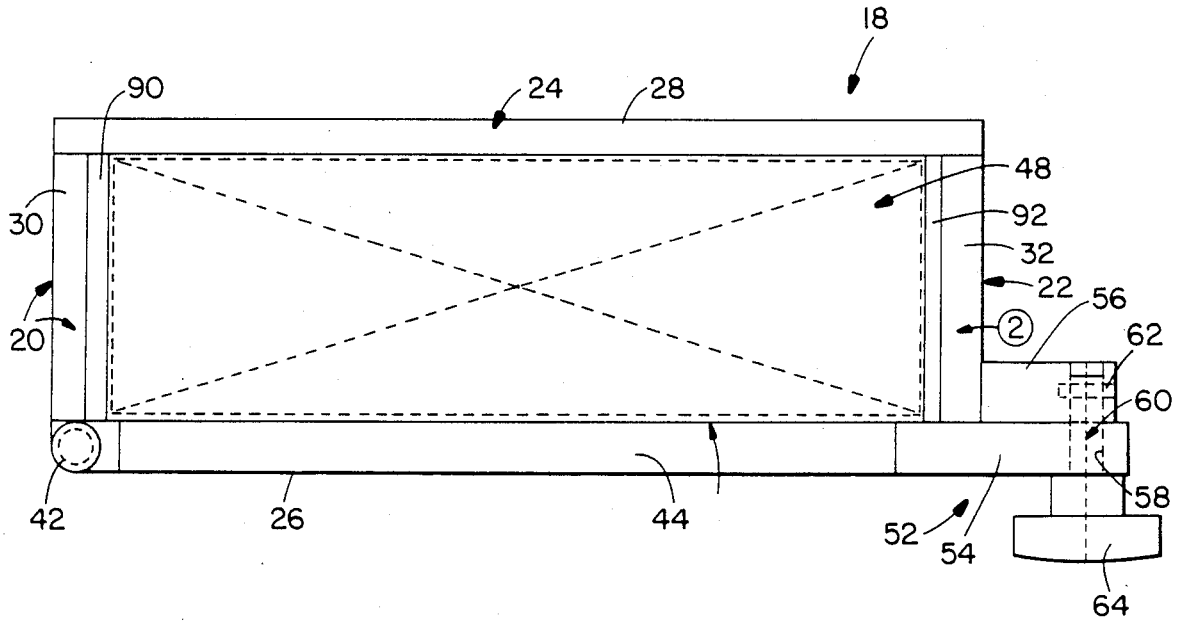
FIG. 4 is a top view of the hopper of FIG. 3.
Figure 5:
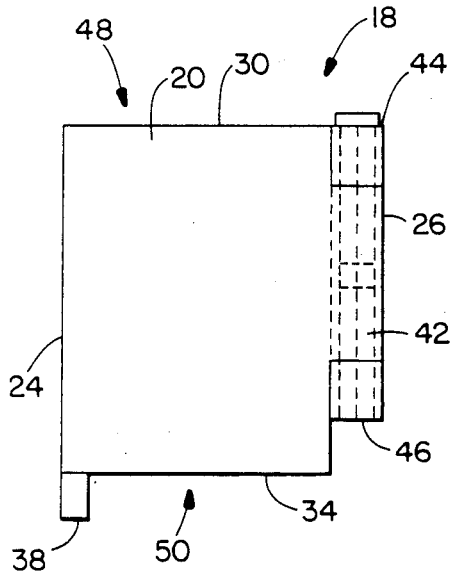
FIG. 5 is a left side view of the hopper.

First, with reference to FIG. 1, there is shown a partially packaged carton 10, circumscribed by a film overwrapper 12 having two end flaps 14 and 16 at the ends of the carton 10 with one end flap 14 folded over the carton end and the other end flap 16 yet to be folded over the carton end.

With reference to FIG. 2, there is shown a completed packaged carton wherein the end flap 16 is folded over the carton end thereby enclosing the entire carton in the overwrapper 12.

With reference to FIGS. 2 - 6, there is shown a hopper, generally denoted as the numeral 18, which is used to complete the packaging of the carton 10 by folding the remaining end flaps 16 over the carton ends at both ends of the carton 10 as the carton 10 moves through the hopper 18.

The hopper 18 includes first and second spaced apart, parallel side walls 20 and 22, a back wall 24, and a front access door 26. The back wall 24 is perpendicular to and spans the space between the side walls 20, 22, and is affixed to the back vertical edges of the side walls 20, 22. The horizontal top edge 28 of the back wall 24 is in the plane of the horizontal top edges 30 and 32 of the first and second side walls 20 and 22, respectively. Also, the back wall 24 extends downwardly past the horizontal bottom edges 34 and 36 of the side walls 20 and 22, respectively, such that the horizontal bottom edqe 38 of the back wall 24 is at an elevation beneath that of the horizontal bottom edges 34 and 36 of the side walls 20 and 22.

The access door 26 is pivotably attached to the vertical front edge of the first side wall 20 by a hinge 42 for movement between a closed position spanning the space between the side walls 20, 22 and parallel to the back wall 24 closing the front of the hopper 18, and an open position away from the space between the side walls 20, 22 opening the front ride of the hopper 18. The access door 40 has a horizontal top edge 44 in the plane of the horizontal top edges of the back wall 24 and the horizontal top edges of the side walls 20, 22, and a horizontal bottom edge 46 at an elevation above that of the horizontal bottom edqe 34, 36 of the side walls 20, 22.

The horizontal top edges 30, 32 of the side walls 20, 22, the horizontal top edge 28 of the back wall 24, and the horizontal top edge 44 of the closed access door 26 define the open top end 48 of the hopper 18. The horizontal bottom edges 34, 36 of the side walls 20, 22, the horizontal bottom edge 38 of the back wall 24, and the horizontal bottom edge 46 of the closed access door 26 define the open bottom end 50 of the hopper 18.

A latch means 52 interconnects the access door 26 and the second side wall 22 to latch the access door 40 in the closed position. As shown, the latch means 52 includes a first flange 54 extending laterally outwardly from the side of the access door 26 opposite the side thereof having the hinge 42, and a second flange 56 extending transversely outwardly from the second side wall 22 at the front vertical edge thereof, when the access door 26 is closed the first flange 54 is in adjacent parallel relationship to the second flange 56. The first flange 54 is formed with a vertical notch 58 open to the top edge of the first flange 54. A threaded rod 60 is attached at one of its ends by a horizontal pivot pin 62 to the second flange 56 in alignment with the notch 58 in the first flange 54. The rod 60 is movable in a vertical plane about the pivot pin 62 between a horizontal position received in the vertical notch 58 in the first flange 54 and a vertical position out of the vertical notch 58. A handle or knob 64 has an appropriately threaded bore which threadably receives the free end of the thread so as to abut the front surface of the first flange 54 when the rod 60 is in the horizontal position received in the notch 58 of the first flange 54. When the knob 64 is threaded down on the threaded rod 60 it tightly abuts the first flange 54 catching it between the knob 64 and second flange 56 holding the door closed. To open the access door 26, the knob 60 is unthreaded from the rod 60 until there is enough clearance between it and the front surface of the first flange 54 to provide for pivoting the rod 60 upwardly about the pivot pin 62 and out of the vertical notch 58 thereby freeing the access door for pivotal movement to the open position about the hinge 42.

Figure 6:
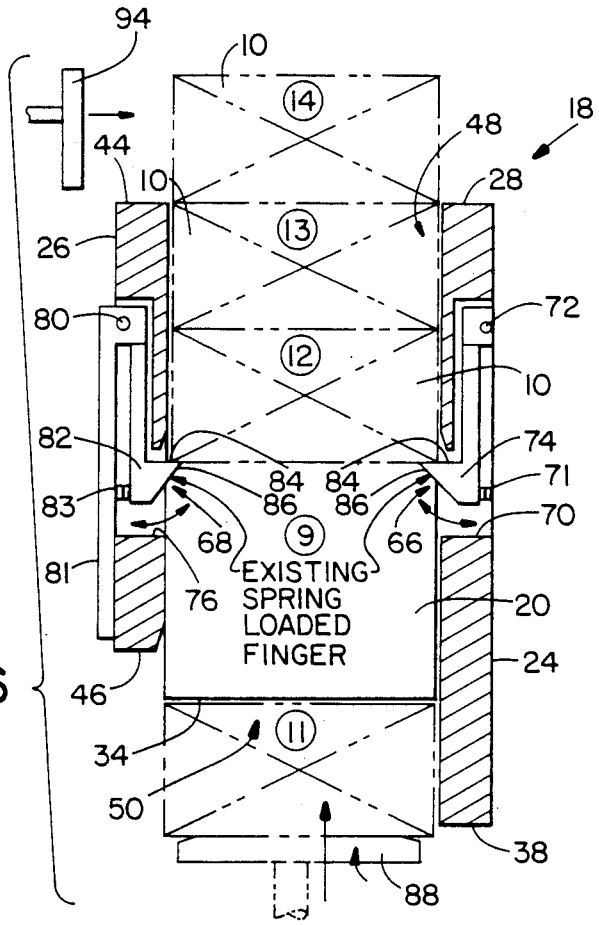
FIG. 6 is a cross-sectioned side view of the hopper as seen in the direction of arrows 6-6 in FIG. 3.

With particular reference to FIGS. 1 and 6, the hopper 18 also includes first carton engagement fingers 66 structurally associated with the back wall 24 and second carton engagement fingers 68 structurally associated with the access door 26 across from and at the same elevation of the hopper 18 as the first carton engagement fingers 66. The first carton engagement fingers 66 are located within a pocket 70 formed in the back wall 24 and are mounted therein for pivotable movement about a pivot pin 72 at its proximal end. The first carton engagement fingers 66 also have a transverse projection 74 at their distal end. The first carton engagement fingers 66 are movable about the pivot pin 72 between a first position with the transverse projection 74 projecting into the hopper toward the closed access door 26, and second position with the transverse projection 74 retracted out of the hopper 18 into the pocket 70. Also, the first carton engagement finqers 66 are biased to the first position by a spring 71 behind the fingers 66. The second carton engagement fingers 68 are located within a pocket 76 in the access door 26. As shown, the pocket 76 is formed through the access door 26. The second carton engagement fingers 68 are mounted for pivotable movement about a pivot pin 80 at their proximate end to a bracket 81 mounted to the front side of the access door 26 and extending across the pocket 76. The second carton engagement fingers 68 also have a transverse projection 82 at its distal end. The second carton engagement fingers 68 are movable about the pivot pin 80 between a first position with the transverse projection 82 projecting into the hopper toward the back wall 24 in alignment with the transverse projection 74 of the first carton engagement fingers 66, and a second position with the transverse projection 82 retracted out of the hopper 18 into the pocket 76. The second carton engagement fingers 68 are biased to the first position by a spring 83 behind the fingers 68. Each of the transverse projections 74 and 82 defines a top flat side 84 for engagement with the bottom side of a carton 10 to hold the carton 10 in position within the hopper 18, and a slanted bottom side 86 which functions as a cam surface to pivot the fingers 66 and 68 to the second position as a carton 10 is moved upwardly in the hopper 18 and contacts the slanted bottom sides of the fingers 66 and 68.

An elevator plate 88 is located beneath the open bottom end 50 of the hopper 18 for pushing cartons 10 upwardly into the hopper to a position above and resting on the transverse projections 74 and 82 of the fingers 66 and 68.

In addition, a pair of heated overwrapper end flap sealing plates 90 and 92 are located over the open top end 48 of the hopper 18 above each of the side walls 20 and 22 for contacting the folded over end flaps 14 and 16 at the ends of the carton 10 for sealing them in place over the carton ends. A pusher plate 94 is located above the open top end 48 of the hopper 18 to move horizontally thereacross to push the completed packaged carton away from the hopper 18.

In operation, a partially packed carton 10 circumscribed by a film overwrapper having the bottom one of its end flaps 14 folded upwardly over the carton ends, but the top one of its end flaps 16 yet to be folded downwardly over the carton ends is delivered to the elevator plate 88. The elevator plate 88 is then moved upwardly through the bottom open end 50 of the hopper 18 toward the transverse projections 74, 82 of the fingers 66, 68 carrying the carton 10 on its top surface. The carton 10 moving with the elevator plate 88 first contacts the slanted bottom sides 86 of the transverse projections 74, 82 of the first and second engagement fingers 66, 68 pushing the first and second engagement fingers 66, 68 about their pivot pins 72, 80 against the biasing force of the springs 71, 83 to their second or retracted positions allowing the carton 10 to pass as the elevator plate 88 continues to move upwardly. When the elevator plate 88 has moved the carton 10 past the transverse projections 74 and 82, the first and second carton engagement fingers 66, 68 are pivoted about their pins 72, 80 by the biasing force of the springs 71, 83 to their first or projecting position, and the elevator plate 88 then reverses direction of movement to move downwardly back out through the bottom open end 50 of the hopper 18 leaving the carton 10 supported on the top flat surfaces 84 of the transverse projections 74, 82 of the first and second engagement fingers 66, 68. As the carton 10 moves upwardly in the hopper 18, the side walls 20, 22 contact the top flaps 16 of the overwrapper causing them to fold downwardly over the carton ends. The process is contrived by the elevator plate 88 moving a second carton 10 upwardly in the hopper 18 until it is above the transverse projections 74, 82 of the first and second engagement fingers 66, 68. The second carton 10 contacts the previous carton 10 already resting on the transverse projections 74 82 and pushes it upwardly in the hopper 18. Typically, as can be best seen in FIG. 6, at any one time, two cartons 10 are stacked within the hopper 18 and a third carton 10 is supported on the top most carton 10 in the hopper 18 above the open top end 48 of the hopper 18. The first and second heated sealing plates 90, 92 contact the folded over flaps 14, 16 across the carton ends of the carton 10 above the open top end 48 to seal the flaps 14, 16 closed, and the pusher plate 94 pushes the completed packaged carton transversely of the hopper 18 away from the open top end 48.

From time to time, a carton 10 may jam in the hopper 18, or the cartons in the hopper 18 may have to be removed from the hopper 18 for some other reason. In this event, the access door 40 is merely moved to its second or open position which, due to the fact that the access door 40 is coextensive with the length and width of the hopper 18, completely opens the hopper 18 making it extremely easy to remove selected ones or all of the cartons 10 from the hopper 18.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A hopper for folding the end flaps of a film overwrapper across the ends of a carton circumscribed by the overwrapper to complete the packaging of the carton comprising:

first and second spaced apart, parallel side walls;

a back wall perpendicular to and spanning the space between the side walls, said side walls having back vertical edges and said back wall being affixed to the back vertical edges of the side walls;

an access door pivotably attached to the verticals front edge of the first side wall for movement between a closed position spanning the space between the side walls and parallel to the back wall closing the entire front side of the hopper and an open position away from the space between the first and second side walls completely opening the front side of the hopper;

said first and second side walls, said top back wall, and said access door having top edges, said top edges in the closed position cooperating to define a top open end of the hopper;

said first and second side walls, said back wall, and said access door having bottom edges, said bottom edges in the closed position cooperating to define a bottom open end of the hopper; and, latch means interconnecting the access door and the second side wall to latch the access door in the closed position.

2. The hopper of claim 1, further comprising:

first carton engagement finger means structurally associated with the hopper back wall;

means for mounting the first carton engagement finger means to the back wall for movement between a first position projecting from the back wall into the hopper toward the access door and a second position retracted out of the hopper;

second carton engagement finger means structurally associated with the access door at the same elevation of the hopper as the first carton engagement finger means; and, means for mounting the second carton engagement finger means to the access door for movement between a first position projecting from the access door into the hopper toward the back wall and a second position retracted out of the hopper.

3. The hopper of claim 2, further comprising:

means for biasing the first carton engagement finger means to the first position; and means for biasing the second carton engagement finger means to the first position.

4. The hopper of claim 2, further comprising:

means defining a pocket in the back wall for receiving the first carton engagement finger means in the second retracted position; and, means defining a pocket in the access door for receiving the second carton engagement finger means in the second retracted position.

5. The hopper of claim 2, wherein:

the means for mounting the first carton engagement finger means comprises pivot means at the proximal end of the first finger means; and, the means for mounting the second carton engagement finger means comprises pivot means at the proximal end of the second finger means.

6. The hopper of claim 5, wherein:

the first carton engagement finger means comprises a transverse projection at its distal end for engaging a carton in the hopper when in the first position; and the second carton engagement finger means comprises a transverse projection at its distal end for engaging a carton in the hopper when in the first position.

7. The hopper of claim 6, wherein:

the transverse projection of the first carton engagement finger means has a flat top side for engagement with the bottom side of a carton to support the carton thereon in the hopper and a slanted bottom side defining a cam surface for causing the first carton engagement finger means to pivot about the pivot means to the second retracted position as a carton in the hopper contacts the slanted bottom cam side; and, the transverse projection of the second carton engagement finger means has a flat top side for engagement with the bottom side of a carton to support the carton thereon in the hopper, and a slanted bottom side defining a cam surface for easing the second carton engagement finger means to pivot about the pivot means to the second retracted position as a carton in the hopper contacts the slanted bottom cam side.

8. The hopper of claim 1, wherein the horizontal top edge of the back wall, horizontal top edges of the first and second side walls, and the top horizontal edge of the access door are in the same plane.

9. The hopper of claim 8, wherein the horizontal bottom edge of the back wall is at an elevation beneath the horizontal bottom edges of the side walls, and the horizontal bottom edqe of the access door is at an elevation above the horizontal bottom edges of the side walls.

* * * * *